US005098749A

United States Patent [19]

Gabriel et al.

[11] Patent Number: 5,098,749

[45] Date of Patent: Mar. 24, 1992

[54] WORKPIECE-TREATING SYSTEM AND RELATED METHOD

[75] Inventors: William L. Gabriel, Barrington; Geronimo E. Lat, Prospect Heights; Dieter G. Boigk, Skokie, all of Ill.

[73] Assignee: Illinois Tool Works Inc., Glenview, Ill.

[21] Appl. No.: 519,435

[22] Filed: May 4, 1990

[51] Int. Cl.[5] ..... B05D 1/18; B05C 3/10

[52] U.S. Cl. ..... 427/430.1; 118/425; 118/426; 118/428; 118/500

[58] Field of Search ..... 118/400, 423, 425, 428, 118/429, 500, 426; 204/199; 427/430.1

[56] References Cited

U.S. PATENT DOCUMENTS

| | | | |
|---|---|---|---|
| 2,341,197 | 2/1944 | Wetskopf | 118/425 |
| 2,341,198 | 2/1944 | Weiskopf | 118/425 |
| 2,583,379 | 1/1952 | Kling | 118/425 |
| 2,646,807 | 7/1953 | Martin | 118/425 |
| 3,762,362 | 10/1973 | Lishaw | 118/425 |
| 3,809,008 | 5/1974 | Takahashi | 118/425 |

*Primary Examiner*—Willard E. Hoag

*Attorney, Agent, or Firm*—Schwartz & Weinrieb

[57] ABSTRACT

A workpiece-treating system and a related method are disclosed. Workpeices, such as for example coils of collated nails, are conveyed successively into a first container for treatment within a first bath, such as, for example a nail-cleaning bath, out from the first container, into a second container for treatment within a second bath, such as, for example nail-coating bath, and out from the second bath. A carrousel having three workpiece-holding platforms is used to convey the workpieces as mentioned. Means are provided for mounting the carrousel so as to enable the platforms to be conjointly and selectively raised or lowered and to enable the carrousel to be selectively indexed about a vertical axis through a cycle of three working positions when the platforms are raised. Means are provided for rotating each platform about a vertical axis for a selected period of time. The respective containers are positioned where a selected platform is lowerable into the first container and a different platform is lowerable into the second container in each working position of the carrousel.

18 Claims, 4 Drawing Sheets

AIR
82
40
84
10
80
72
62
76
74
74
74
86
64
66
68
90
60
92
196
48
46
92
148
156
146
150
48
32
134
148
48
12
34
154
160
162
18
172
140
130
138
88
132
136
144
110
142
106
180
100
178
102

FIG. 7
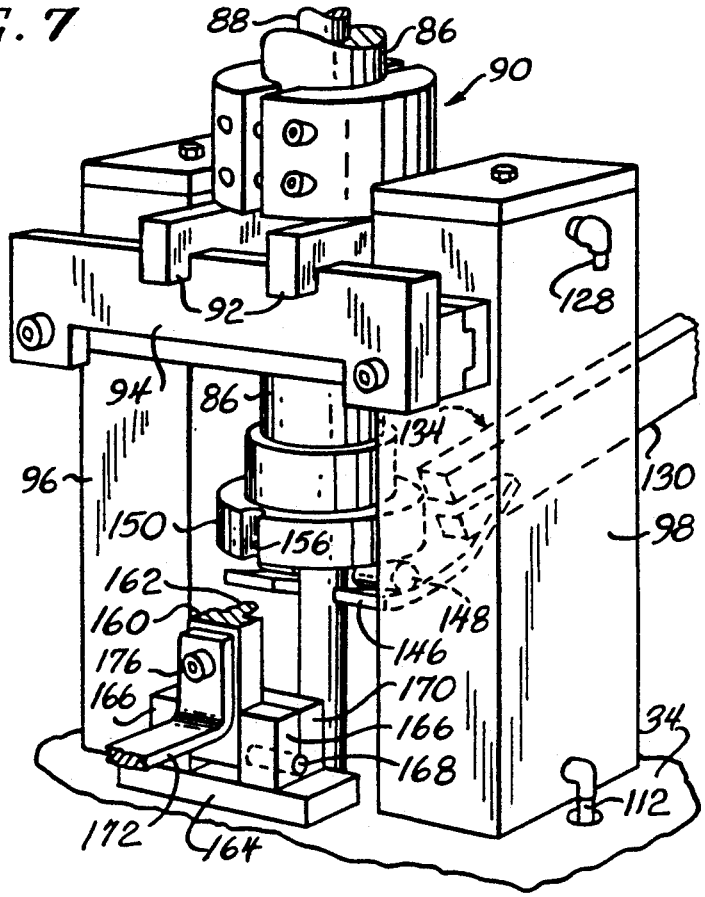
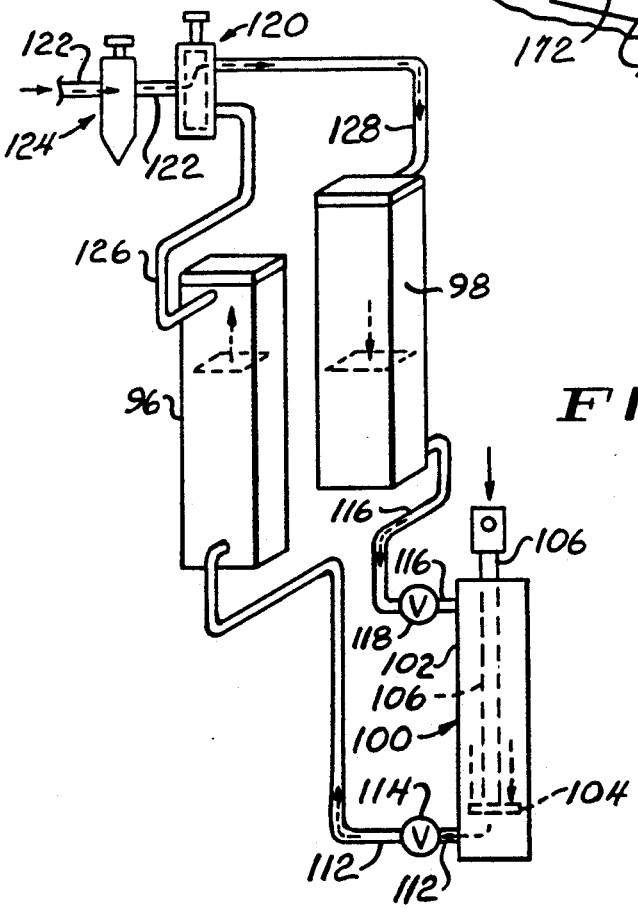
FIG. 8

WORKPIECE-TREATING SYSTEM AND RELATED METHOD

TECHNICAL FIELD OF THE INVENTION

This invention pertains to a workpiece-treating system employing a workpiece-treating bath and means for conveying workpieces, such as, for example, coils of collated nails, into and from the bath. The system may employ two workpiece-treating baths, such as, for example, a nail-cleaning bath and a nail-coating bath. This invention pertains also to a related method.

BACKGROUND OF THE INVENTION

If wire nails are formed from pre-galvanized, carbon steel wire, which has a protective zinc layer disposed thereon, flaws tend to be produced within such layer, particularly upon the heads of such nails.

Frequently, such nails are collated so as to be magazine-fed within pneumatically powered or other nailing tools. Commonly, such nails are collated by means of parallel wires welded to the shanks of such nails. Other collating media, such as, for example, polymeric collating strips, may be alternatively used. The collated nails may be wound into coils.

If such nails are intended for outdoor usage, it is a practical necessity to apply a protective outer coat, such as, for example, a polymeric outer coat, to such nails. Such coat covers flaws that may be present within the zinc layer. Before such a coat can be properly applied, it is a practical necessity to clean such nails.

There has been a need, to which this invention is addressed, for a semi-automatic system that can be readily adapted to cleaning and coating wire nails, particularly coils of collated nails, as described above.

SUMMARY OF THE INVENTION

This invention provides a workpiece-treating system and is also directed toward a related method. Although neither the system nor the method is limited to cleaning or coating coils of wire nails, the system and the method of the present invention may be advantageously utilized to clean and coat such coils of wire nails.

Broadly, the workpiece-treating system comprises a container, which has an open top, and a mechanism for conveying workpieces into and out from the container. The container is adapted to contain a workpiece-treating bath. The conveying mechanism comprises a carrousel and a mechanism for mounting the carrousel so as to enable certain operations to occur.

The carrousel has workpiece-holding platforms. Each platform is configured so as to fit into the container through means of the open top thereof.

One function of the carrousel-mounting mechanism is to enable each platform to be selectively raised to an upper level or lowered to a lower level. Another function of the same mechanism is to enable the carrousel to be selectively indexed through a cycle of working positions or stations when each platform is raised to the upper level, and preferably to enable the carrousel to be rotatably indexed about a vertical axis to any one of the working positions.

The container is positioned at a specific location relative to the carrousel. The container is positioned such that a selected one of the platforms of the carrousel is able to be lowered into the container through means of the open top of the container when the carrousel is disposed at any one of its working position of the carrousel.

It is preferred that the carrousel is constructed in such a manner that the platforms must be conjointly raised to the upper level or lowered to the lower level. It is preferred, moreover, that the means for mounting the carrousel also comprises means for rotating each platform individually, about a vertical axis, for a selected period of time.

Preferably, each platform comprises an array of upright posts. Each post may be either adapted to hold a workpiece configured to fit directly onto such post or may be provided with a removable, frusto-conical spacer fitted over such post, each spacer being adapted to hold a workpiece configured to fit onto such spacer. Each spacer may be specifically adapted to hold a coil of collated nails.

In a preferred arrangement, the workpiece-treating system comprises a first container and a second container, each having an open top, and a conveying mechanism as described above. The conveying mechanism is used for conveying workpieces successively into the first container, out from the first container, into the second container, and out from the second container. The first container is adapted to contain a workpiece-treating bath of a first composition. The second container is adapted to contain a workpiece-treating bath of a second composition.

In the preferred arrangement, the carrousel has three workpiece-holding platforms. Each platform is configured to fit into each container through means of its open top.

The respective containers of the preferred arrangement are positioned at specified locations relative to the carrousel. Thus, at each working position of the carrousel such containers are positioned such that a respective one of the platforms is able to be lowered into the first container through means of its open top for each working position of the carrousel. Also, such containers are positioned such that a different one of the platforms is able to be lowered into the second container through means of its open top at each working position of the carrousel.

As a further feature of the preferred arrangement, the conveying mechanism comprises a locking and unlocking device, which is movable between a locking position and an unlocking position. When moved to the locking position, such device locks the carrousel at a selected one of the working positions, in such a manner that the platforms can than be raised or lowered however the carrousel cannot be indexed to a different one of the working positions. In the unlocking position, such device unlocks the carrousel, which can then be indexed. Preferably, such device is biased toward the locking position and comprises a pedal, which is arranged to move such device to the unlocking position when depressed.

Broadly, the workpiece-treating method provided by means of this invention employs a workpiece-treating bath within a container having an open top, as described above, and means for conveying workpieces into and out from the bath, as described above. Two platforms of the carrousel are designated respectively as a first platform and a second platform.

In accordance with a first group of steps, a treated workpiece is removed from the first platform and an untreated workpiece is placed upon the first platform. The carrousel is indexed to a working position at which the first platform is able to be lowered into the container through means of the open top thereof.

Next, the first platform is lowered into the container. After a suitable period of time, the first platform is raised from the container.

In accordance with a subsequent group of steps, similar steps are performed. However, the second platform is employed where the first platform was employed in accordance with the first series of steps.

In a preferred mode, the workpiece-treating method provided by means of this invention employs a workpiece-treating bath of a first composition disposed within a first container, a workpiece-treating bath of a second composition disposed within a second container, and a mechanism as described above for conveying workpieces successively into the first container, out from the first container, into the second container, and out from the second container.

In accordance with a first group of steps in the preferred mode, a treated workpiece is removed from the first platform and an untreated workpiece is placed onto the first platform. Also, the carrousel is indexed to a working position at which the first container is able to be lowered into the first container and at which the second platform is able to be lowered into the second container. Next, the platforms are lowered to the lower level, whereby the first platform is lowered into the first container and the second platform is lowered into the second container. After a suitable period of time, the platforms are raised to the upper level, whereby the first platform is raised from the first container and the second platform is raised from the second container.

In accordance with a second group of steps in the preferred mode, similar steps are performed. However, the third and first platforms are employed in accordance with this second group of steps whereas the first and second platforms were employed in accordance with the first group of steps. In a third group of steps in the preferred mode, similar steps are performed again. However, the second and third platforms are employed in accordance with this third group of steps whereas the first and second platform were employed in accordance with the first group of steps and wherein the third and first platforms were employed in accordance with the second group of steps. The first, second, and third groups of steps are repeated for an arbitrary number of cycles.

In accordance with one preferred application of the workpiece-treating method, each platform comprises an array of upright posts. Each post is adapted to hold a workpiece which is configured to fit onto such post. Each post may also be provided with a frusto-conical spacer, which is adapted to hold a workpiece which is configured to fit onto such spacer. The spacer may be removably or permanently mounted upon the post. Moreover, each placing step includes placing a plurality of similar workpieces, each workpiece being placed onto a different one of the posts.

As an example, each workpiece may comprise a coil of collated nails. Thus, the workpiece-treating bath of the first composition may be a nail-cleaning bath. Also, the workpiece-treating bath of the second composition may be a nail-coating bath.

BRIEF DESCRIPTION OF THE DRAWINGS

These and other objects, features, and advantages of this invention will become evident from the following description of a preferred embodiment of this invention with reference to the accompanying drawings in which like reference characters designate like or corresponding parts throughout the several views, and wherein:

FIG. 7, on an enlarged scale compared to that of FIG. 4, is a fragmentary, perspective view of certain elements of the workpiece-treating system, as viewed from a different vantage point.

FIG. 8 is a schematic representation of certain fluid-powered components of the workpiece-treating system.

DETAILED DESCRIPTION OF PREFERRED EMBODIMENT

Figure 1:
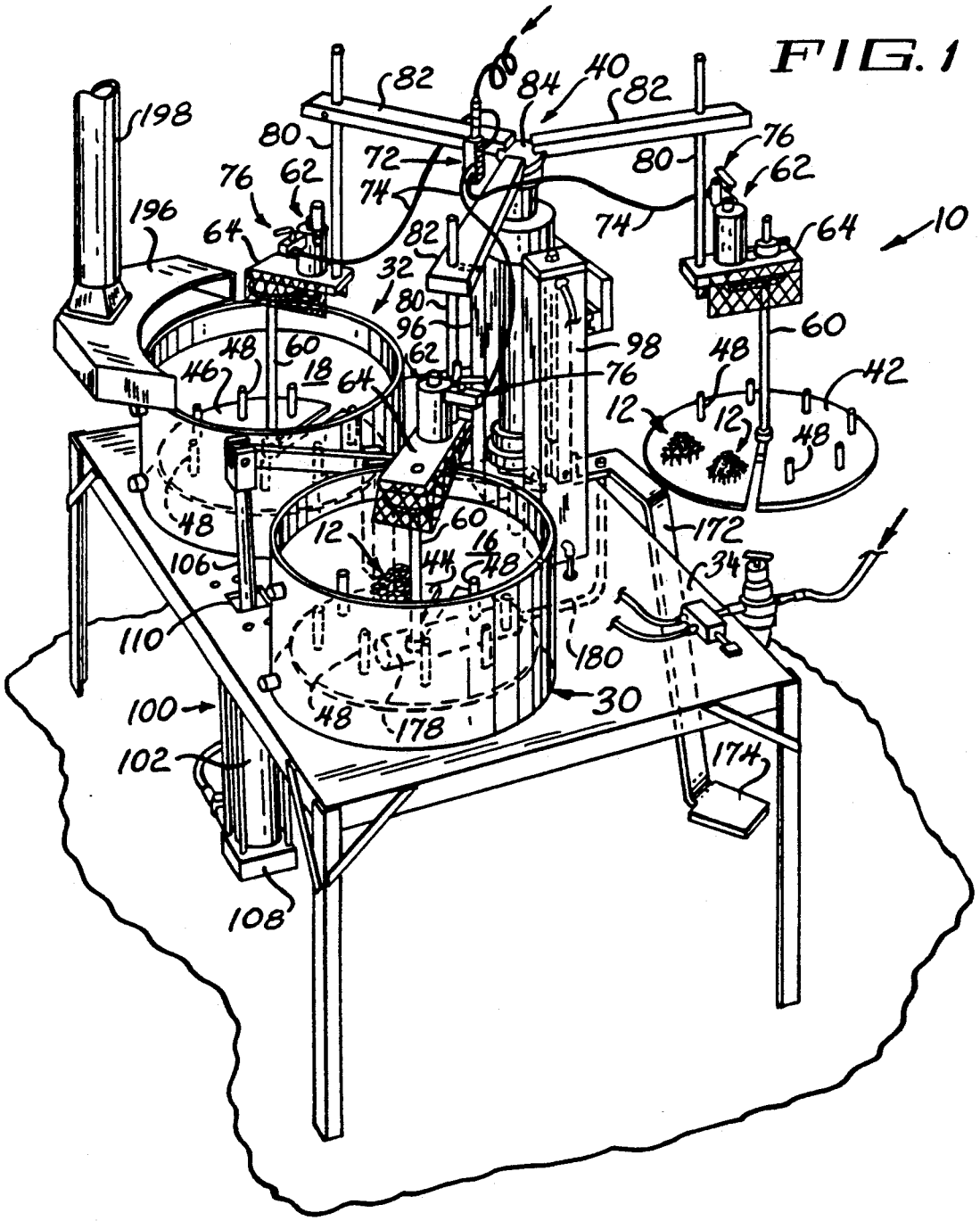
FIG. 1 is a perspective view of various elements of a workpiece-treating system constructed in accordance with a preferred embodiment of this invention, in an application wherein coils of collated nails are being treated successively within a nail-cleaning bath and within a nail-coating bath. Certain elements, which appear in other views, are omitted from FIG. 1 for the sake of clarity in connection with the showing of other elements.

A preferred embodiment of this invention is described below. It should be understood that the present disclosure is an exemplification of this invention and that this invention is not limited to the embodiment illustrated and described.

As illustrated in the drawings, a workpiece-treating system 10 constitutes a preferred embodiment of this invention. The system 10 is shown as adapted to treat individual coils 12 of wire nails 14 by cleaning such nails 14 within a nail-cleaning bath 16 and by coating such nails 14 within a nail-coating bath 18. The system 10 can be readily adapted to treat other workpieces of various types.

Figure 2:
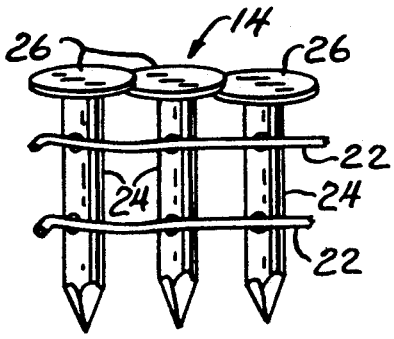
FIG. 2 is a greatly enlarged perspective view of three nails from one of the coils.
Figure 3:
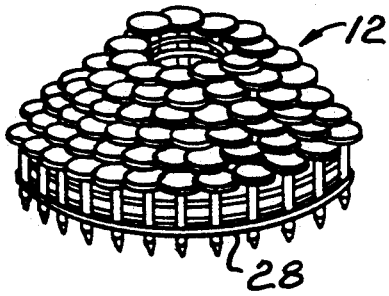
FIG. 3 is a somewhat smaller view of a coil of collated nails.

As best shown within FIG. 2, the nails 14 in each coil 12 are collated by means of two parallel wires 22, which are welded to their respective shanks 24. Each of the nails 14, as shown, is formed with an enlarged head 26. A rubber band 28 shown in FIG. 3 or a wire tie (not shown) may be optionally used to consolidate each coil 12 while the nails 14 in such coil 12 are being treated, particularly if such coil 12 tends to uncoil as it is being handled within the system 10.

A first container 30 having a cylindrical side wall and an open top is provided, which contains the nail-cleaning bath 16. A second container 32 having a cylindrical side wall and an open top is provided, which contains the nail-coating bath 18. The containers 30, 32, are similar except for their contents. Each of the containers 30, 32, is supported upon a table 34.

A preferred composition for the nail-cleaning bath is 1,1,1 trichloroethane. A preferred composition for the nail-coating bath 18 is an acrylic-based coating, as available commercially from Finnaren & Haley, Inc., Conshohocken, Pa.

Besides the containers 30, 32, the system 10 comprises means for conveying the coils 12 or other workpieces (not shown) successively into the first container 30, out from the first container 30, into the second container 32, and out from the second container 32. Broadly, the means for conveying the coils 12 or other workpieces comprises a carrousel 40 and means for mounting the carrousel 40 so as to enable certain operations to occur.

The carrousel 40 has three workpiece-holding platforms, namely a first platform 42, a second platform 44, and a third platform 46. Each of the platforms 42, 44, 46, has a substantially circular configuration, as shown, and is configured to fit into each of the containers 30, 32, through means of its open end or top.

Each of the platforms 42, 44, 46, has a circular array of eight upright posts 48, which are spaced regularly from one another upon such platform. Each post 48 is adapted to hold one of the coils 12. Each post 48 may be optionally provided with a removable, frusto-conical spacer 50, which is adapted to hold one of the coils 12. The spacers may be conveniently molded from a polymeric material, such as, for example, polyethylene, or may be alternatively made from aluminum. Alternatively, such a spacer may be permanently mounted upon each post 48.

Figure 6:
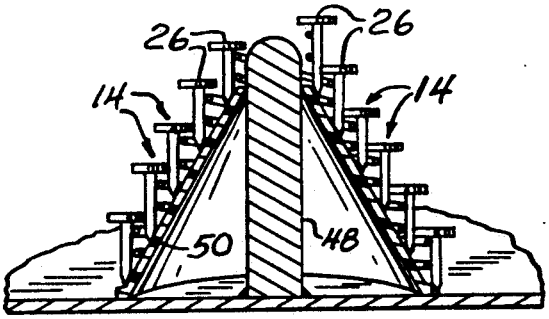
FIG. 6, on an enlarged scale compared to that of FIG. 2, is a cross-sectional view of one of the coils of collated nails as mounted upon one of the spacers fixed upon one of the three platforms of the workpiece-treating system.

Each of the coils 12 is configured so as to fit onto one of the spacers 50. If the spacers 50 are used, the spacers 50 separate the heads 26 of the nails 14 from one another, as shown in FIG. 6.

Figure 5:
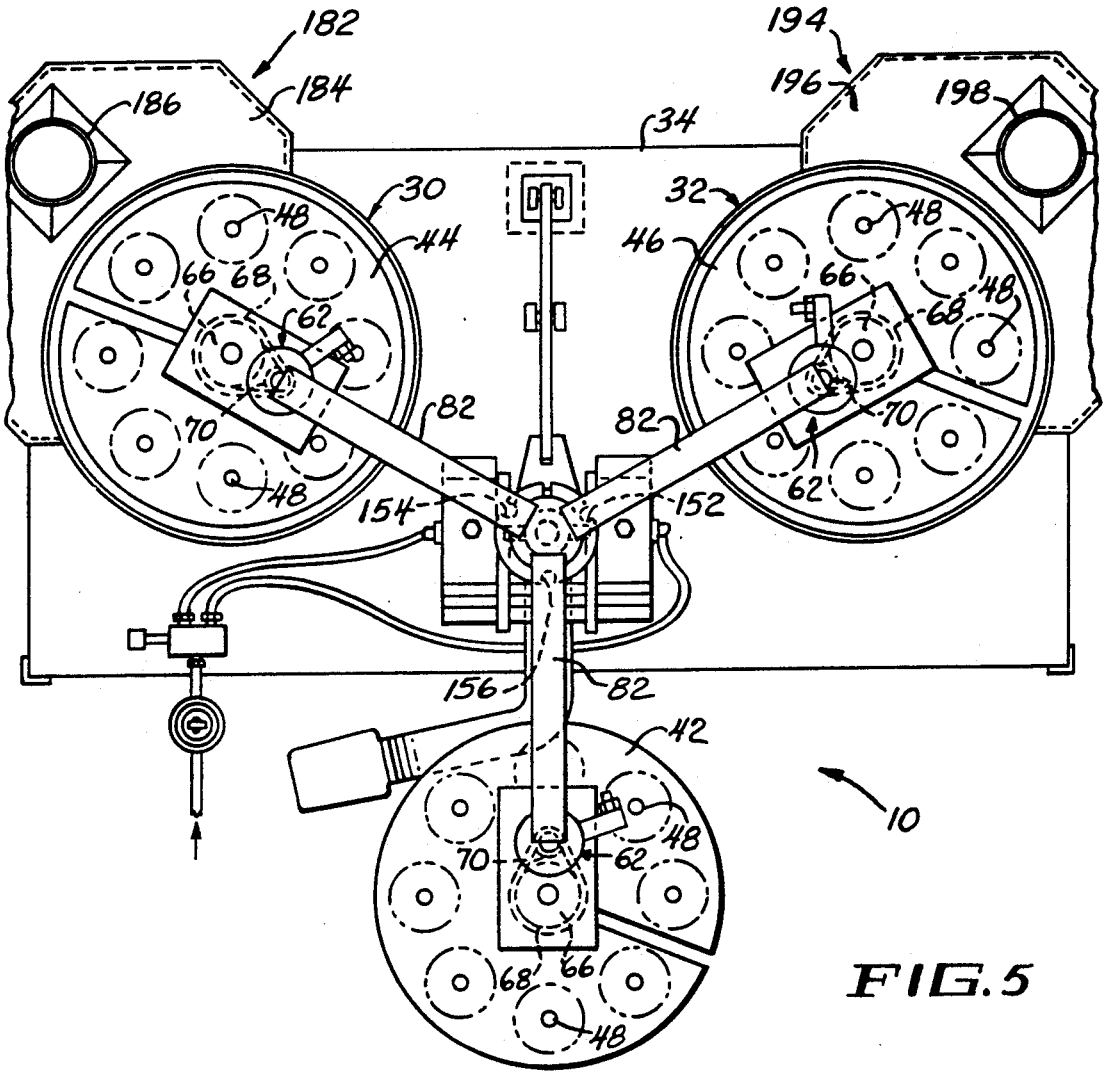
FIG. 5, on a slightly smaller scale, is a partly fragmentary, plan view of certain elements of the workpiece-treating system.

Each of the platforms 42, 44, 46, is mounted upon the lower end of a rotatable shaft 60, with which such platform is arranged to be conjointly rotatable. A pneumatically powered motor 62, which is supported upon a supporting plate 64, is associated with each such platform and is arranged to rotate the associated platform, by means of a gear 66 driven by means of the motor 62, a driving belt 68, and a gear 70 mounted upon the associated shaft 60, whenever the motor 62 is actuated, all as best seen in FIG. 5. The motors 62 are connected to a common source (not shown) of compressed air, by means of a rotary union 72 upon the carrousel 40, and by means of flexible conduits 74 between the rotary union 72 and the motors 62. Each motor 62 is arranged to be selectively actuated or deactuated, by means of a manually actuatable valve 76 mounted upon each motor 62 and arranged to control the compressed air conducted to each motor 62.

Each supporting plate 64 is suspended from a vertical rod 80, which is suspended from a radial arm 82. Each arm 82 is cantilevered from a central hub 84. The radial arms 82 radiate from the hub 84 and are spaced angularly from one another by an angular separation of approximately 120. The hub 84 is mounted rigidly upon the upper end of a tubular mast 86. The mast 86 is mounted upon a vertical spindle 88 for vertical movement of the mast 86 along the spindle 88 and for rotary movement of the mast 86 about the spindle 88. The spindle 88 extends upwardly from the table 34, to which the lower end of the spindle 88 is fixed.

The mast 86 is mounted within a two-part collar 90 for vertical movement of the mast 86 through the collar 90. Each part of the collar 90 is mounted rigidly upon a different one of two transverse bars 92. As shown in FIG. 7, each bar 92 is mounted rigidly at one of its ends to a cross bar 94. The cross bar 94 is mounted rigidly at each of its opposite ends to one of two fluidic enclosures 96, 98, to be later described. Each of the fluidic enclosures 96, 98, is mounted rigidly upon the table 34 and extends vertically upwardly from the table 34. The collar 90 stabilizes the mast 86 and other components movable conjointly with the mast 86.

As shown schematically in FIG. 8, fluidic mechanisms are used to raise the platforms 42, 44, 46 conjointly to an upper level or to lower the platforms 42, 44, 46, conjointly to a lower level. These mechanisms comprise the fluidic enclosures 96, 98, and a hydraulic piston-cylinder mechanism 100.

The mechanism 100 includes a cylinder 102, a piston 104 operative within the cylinder 102, and a rod 106 connected to the piston 104 and extending outwardly from the cylinder 102. The cylinder 102 is mounted upon a support 108, beneath the table 34, in such a manner that the mechanism 100 can pivot over a limited range of pivotal movement. The rod 106 is movable conjointly with the piston 104 and extends upwardly through a slot 110 defined within the table 34. The slot 110 accommodates pivotal movement of the mechanism 100.

Each of the fluidic enclosures 96, 98, contains a quantity of hydraulic fluid, and a head space, into which compressed air is admissible. The sump space of the enclosure 96 is connected, by means of two conduits 112 with a throttling valve 114, therebetween, to the lower end of the cylinder 102. The sump space of the enclosure 98 is connected, by means of two conduits 116 with a throttling valve 118 therebetween, to the upper end of the cylinder 102.

When hydraulic fluid is driven from the sump space of the enclosure 96, through means of the conduits 112, into the lower end of the cylinder 102, the piston 104 and the rod 106 are driven upwardly. Consequently, hydraulic fluid is driven from the upper end of the cylinder 102, through means of the conduits 116, into the enclosure 98, within which trapped air within the head space is compressed.

When the hydraulic fluid is driven from the sump space of the enclosure 98, through means of the conduits 116, into the upper end of the cylinder 102, the piston 104 and the rod 106 are driven downwardly. Consequently, hydraulic fluid is driven from the lower end of the cylinder 102, through means of the conduits 112, into the enclosure 96, in which trapped air within the head space is compressed.

Compressed air is used selectively to drive hydraulic fluid from the sump space of the enclosure 96 into the lower end of the cylinder 102 or to drive hydraulic fluid from the sump space of the enclosure 98 into the upper end of the cylinder 102. A manually actuatable valve 120 is connected, by means of two conduits 122 with a pressure regulator 124 therebetween, to a source (not shown) of compressed air.

The valve 120 is connected, by means of a conduit 126, to the head space of the fluidic enclosure 96 and is connected by means of a conduit 128, to the head space of the fluidic enclosure 98. The valve 120 is actuatable so as to direct compressed air selectively to the head space of the enclosure 96 so as to drive hydraulic fluid from the sump space of the enclosure 96, or to direct compressed air to the head space of the enclosure 98, so as to drive hydraulic fluid from the sump space of the enclosure 98.

A lever 130 having a driven end 132 and a driving end 134 is pivotably mounted upon a post 136 at an intermediate portion of the lever 130. The post 136 is mounted rigidly to the table 34 and extends upwardly from the table 34. The post 136 is provided at its upper end with a pivot yoke 138 accommodating the lever 130 and mounting a pivot pin 140 passing through the lever 130 at its intermediate portion.

The driven end 132 of the lever 130 is pivotably connected to the rod 106 of the hydraulic piston-cylinder mechanism 100. The rod 106 is provided at its upper end with a pivot yoke 142 accommodating the lever 130 and mounting a pivot pin 144 passing through the lever 130 near its driven end.

The driving end 134 of the lever 130 is provided with a fork 146. The fork 146 provides sufficient clearance for the spindle 88 and carries two dowels 148, which are affixed to the fork 146. The dowels 148 are disposed beneath and are adapted to engage a generally annular flange 150 disposed beneath the tubular mast 86. The flange 150 is affixed to the tubular mast 86 for conjoint movement with the mast 86.

Thus, when the driven end 132 of the lever 130 is driven downwardly by means of the mechanism 100, the driving end 134 of the lever 130 is driven upwardly. Consequently, the fork 146 by means of the dowels 148 raises the sleeve 86, along the spindle 88, whereby the carrousel 40 including the platforms 42, 44, 46, is raised to the upper position. The upper position is defined where the stroke of the piston-cylinder mechanism 100 is complete.

Similarly, but conversely when the driven end 132 of the lever 130 is driven upwardly by means of the mechanism 100, the driving end 134 of the lever 130 is driven downwardly. Consequently, the sleeve 86 and the carrousel 40 including the platforms 42, 44, 46, are lowered gravitationally along the spindle 88 to the lower position. The lower position is defined where the fork 146 engages the table 34.

The flange 150 has three peripheral notches 152, 154, 156, as seen in FIG. 5 which extend vertically. These notches are spaced approximately 120° from one another. A generally upright member 160, which is generally T-shaped in cross-section and defines an elongate rib 162 which is configured so as to fit into a selected one of these notches, is pivotally mounted at its lower end to upon a mounting block 164 as seen in FIG. 7.

As shown in FIG. 7, the mounting block 164 is mounted upon the table 34. Two mounting posts 166 are mounted upon the mounting block 164. The mounting posts 166 support a pivot pin 168 passing through the member 160 near its lower end. A cross block 170, which is mounted upon the mounting block 164 and connected to the mounting posts 166, limits pivotal movement of the member 160 toward the flange 150.

A generally vertical lever 172, which includes a pedal 174 at its lower end, is attached near its upper end to the member 160, by means of a fastener 176, near the lower end of the member 160. A counterweight 178 is attached, by means of a bent rod 180, to the lever 172 near the upper end of the lever 172.

The member 160, the lever 172, and the counterweight 178 are arranged in such a manner that the member 160 is biased by means of the counterweight 178 to a locking position and is movable by means of the lever 172 to an unlocking position. In the locking position of the member 160, the elongate rib 162 fits into a selected one of the notches 152, 154, 156, and the carrousel 40, the tubular mast 86, and the flange 150 can only be vertically moved along the spindle 88. In the unlocking position of the member 160, the elongate rib 162 is removed from these notches so as to permit the carrousel 40 to be manually indexed about a vertical axis defined by means of the spindle 88 if the carrousel 40 is raised to the upper position. If the carrousel 40 were not raised to the upper position before rotation of the carrousel 40, the containers 30, 32, would prevent rotation of the carrousel 40.

The notches 152, 154, 156, respectively define first, second, and third working positions of the carrousel. When the rib 162 fits into the notch 152, the carrousel 40 is disposed at the first working position. When the rib 162 fits into the notch 154, the carrousel 40 is disposed at the second working position. When the rib 162 fits into the notch 156, the carrousel 40 is disposed at the third working position.

In each working position of the carrousel 40, the platforms 42, 44, 46, must be conjointly raised or lowered. A selected one of these platforms is lowerable into the first container 30. A different one of these platforms is lowerable into the second container 32. The remaining one of these platforms remains outside the containers 30, 32, at a location where workpieces can be manually placed onto it or removed from it.

Figure 4:
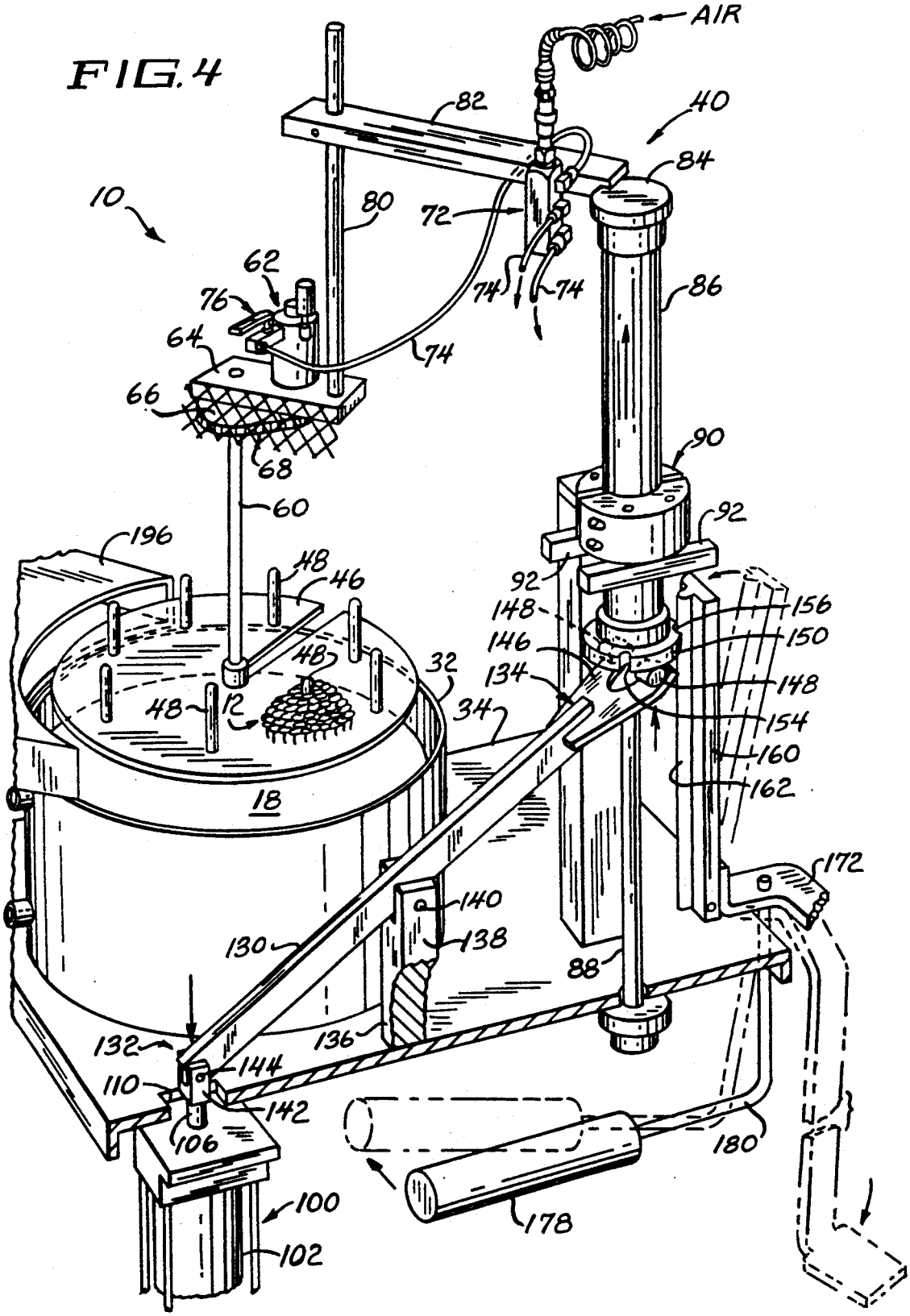
FIG. 4, on an enlarged scale compared to that of FIG. 1, is a fragmentary, perspective view of certain elements of the workpiece-treating system, in changed positions as compared to their positions of FIG. 1.

In the first working position of the carrousel 40, the first platform 42 is lowerable into the first container 30, and the second platform 44 is lowerable into the second container 32. In the second working position of the carrousel 40, the third platform 46 is lowerable into the first container 30, and the first platform 42 is lowerable into the second container 32. In the third working position of the carrousel 40, the second platform 44 is lowerable into the first container 30, and the third platform 46 is lowerable into the second container 32. In FIGS. 1, 4, and 5, the carrousel 40 is shown in the third working position, in which the first platform 42 remains outside the containers 30, 32, at a location where workpieces can be manually placed onto or removed from the first platform.

As shown in FIGS. 1 and 5, each of the containers 30, 32, is equipped with vapor exhaust systems.

Thus, the first container 30 for the nail-cleaning bath 16 is equipped with a cleaning vapor exhaust system 182 including a cowl 184, which is maintained under a partial vacuum, and which exhausts vapor from the bath 16 through means of a conduit 186. Also, the second container 32 for the nail-coating bath 18 is equipped with a coating vapor exhaust system 194 including a cowl 196, which is maintained under a partial vacuum, and which exhausts vapor from the bath 18 through means of a conduit 198.

A preferred method for operating the workpiece-treating system 10, as shown and described, will be described next. The preferred method begins with providing the system 10 with the carrousel 40 at the working position wherein the first platform 42 remains outside the containers 30, 32, namely in the third working position as seen in FIG. 5.

After any cleaned and treated coils 12 of wire nails 14 from any previous operation of the system 10 have been removed manually from the first platform 42, as many as eight such coils 12 are placed manually onto the first platform 42. It does not matter whether the carrousel 40 is in the lower or upper position when such coils 12 are placed onto the first platform 42. Each coil 12 is placed over one of the posts 48, which may be optionally provided with one of the spacers 50.

Next, the carrousel 40 is indexed manually to the first working position. It is necessary to raise the carrousel 40 to the upper level (if it has not been raised previously to the upper level) before indexing it. When the carrousel 40 reaches the first working position, the rib 162 is moved by means of the counterweight 178 into the notch 152.

Thereupon, the valve 120 is actuated manually so as to lower the carrousel 40 to the lower level. Thus, the first platform 42 is lowered into the first container 30. Also, the second platform 44 is lowered into the second container 32. After the carrousel 40 has been lowered, the first platform 42 is rotated for a specified cleaning time, such as for example 5–10 seconds, during which, the nails 14 thereon are cleaned in the nail-cleaning bath 16. If other coils 12 of wire nails 14 were placed previously onto the second platform 44, the second platform 44 is rotated for a specified coating time, such as, for example 5–10 seconds, during which time the nails 14 thereon are coated within the nail-coating bath 18. Afterwards, the valve 120 is actuated manually so as to raise the carrousel 40 to the upper level. Thus, the first platform 42 is raised from the first container 30. Also, the second platform 44 is raised from the second container 32. Preferably the first platform 42 and the second platform 44 are rotated continuously after they have been raised, for at least as long as may be appropriate for drying purposes.

Moreover, either before or after the carrousel 40 is raised to the upper level, any cleaned and coated coils 12 of wire nails 14 from any previous operation of the system 10 are removed manually from the third platform 46. Next, as many as eight coils 12 of wire nails 14 are placed manually onto the third platform 46. Each coil 12 is placed over one of the posts 48, which may be optionally provided with one of the spacers 50. Rotation of the third platform 46 (if continuing theretofore) is halted before any coils 12 are removed from or placed onto the third platform 46.

Next, the carrousel 40 is indexed manually to the second working position. It is necessary to depress the pedal 174, so as to withdraw the rib 162 from the notch 152, before indexing the carrousel 40. When the carrousel 140 reaches the second working position, the rib 162 is moved by means of the counterweight 178 into the notch 154.

Thereupon, the carrousel 40 is lowered to the lower level, whereby the third platform 46 is lowered into the first container 30 and the first platform 42 is lowered into the second container 32. Next, the third platform 46 is rotated for the specified cleaning time, during which time the nails 14 thereon are cleaned within the nail-cleaning bath 16, and the first platform 42 is rotated for the specified coating time, during which time the wire nails 14 thereon are coated within the nail-coating bath 18. Afterwards, the carrousel 40 is raised to the upper level, whereby the third platform 46 is raised from the first container 30 and the first platform 42 is raised from the second container 32. Preferably, the third platform 46 and the first platform 42 are rotated continuously after they have been raised, for at least as long as may be appropriate for drying purposes.

Moreover, either before or after the carrousel 40 is raised to the upper level, any cleaned and coated coils 12 of wire nails 14 from any previous operation of the system 10 are removed manually from the second platform 44. Next, as many as eight coils 12 of wire nails 14 are placed manually onto the second platform 44. Each coil 12 is placed over one of the posts 48, which may be optionally provided with one of the spacers 50. Rotation of the second platform 44 (if continuing theretofore) is halted before any coils 12 are removed from or placed onto the second platform 44.

Next, the carrousel 40 is indexed manually to the third working position. It is necessary to depress the pedal 174, so as to withdraw the rib 162 from the notch 154, before indexing the carrousel 40. When the carrousel 140 reaches the third working position, the rib 162 is moved means of the counterweight 178 into the notch 156.

Thereupon, the carrousel 40 is lowered to the lower level, whereby the second platform 44 is lowered into the first container 30 and the third platform 46 is lowered into the second container 32. Next, the second platform 44 is rotated for the specified cleaning time, during which the wire nails 14 thereon are cleaned within the nail-cleaning bath 16. Also, the third platform 46 is rotated for the specified coating time, during which the wire nails 14 thereon are coated within the nail-coating bath 18. Afterwards, the carrousel 40 is raised to the upper level, whereby the second platform 44 is raised from the first container 30 and the third platform 46 is raised from the second container 32. Preferably, the second platform 44 and the third platform 46 are rotated continuously after they have been raised, for at least as long as may be appropriate for drying purposes.

These steps are repeated for an arbitrary number of cycles. In each cycle, each of the platforms 42, 44, 46, is indexed successively through an operating cycle comprising each of the working positions of the carrousel 40.

Various modifications may be made in the workpiece-treating system 10, or in the preferred method described above for its operation, without departing from the scope and spirit of this invention as defined by means of the appended claims. It is therefore to be understood that within the scope of the appended claims, the present invention may be practiced otherwise than as specifically described herein.

We claim:

1. Workpiece-treating apparatus comprising a container, which has an open top and is adapted to contain a workpiece-treating bath, and means for conveying workpieces into and out from said container, said conveying means comprising:

a carrousel having a plurality of workpiece-holding platforms, each one of said plurality of platforms being configured so as to fit into said container through means of said open top thereof; and means for mounting said carrousel so as to enable each one of said plurality of platforms to be selectively raised to an upper level or lowered to a lower level and so as to enable said carrousel to be selectively indexed through a cycle of working positions when each one of said plurality of platforms is raised to said upper level;

wherein said container is positioned where a selected one of said plurality of platforms is lowerable through said open top of said container and into said container at each working position of said carrousel; and wherein further said means for mounting said carrousel comprises a vertically reciprocable mast for elevating and lowering said carrousel and said workpiece-holding platforms thereof;

first locking means defined upon said vertically reciprocable mast; and second locking means releasably engageable with said first locking means of said mast such that when said second locking means is engaged with said first locking means of said mast, said mast, said carrousel, and said platforms of said carrousel may undergo vertical movement so as to raise one of said platforms out of said container or lower one of said platforms into said container but may not undergo rotary indexed movements between said work positions, yet when said second locking means is released from engagement with said first locking means of said mast, said mast, said carrousel, and said platforms of said carrousel may undergo rotary indexed movements between said work positions provided said mast, said carrousel, and said platforms have been raised to said upper level.

2. The workpiece-treating apparatus of claim 1 wherein the mounting means mounts the carrousel to enable the carrousel to be rotatably indexed about a vertical axis to any of the working positions.

3. The workpiece-treating apparatus of claim 2 wherein the carrousel is constructed in such manner that the platforms must be conjointly raised to the upper level or lowered to the lower level.

4. The workpiece-treating apparatus of claim 2 wherein the conveying means comprises means for rotating each platform about a vertical axis for a selected time.

5. The workpiece-treating apparatus of claim 1, wherein:

said first locking means comprises a plurality of notches defined within said mast and equiangularly spaced about an outer peripheral portion of said mast so as to correspond with said working positions of said carrousel; and said second locking means comprises a pivotable member having a ribbed portion thereof releasably engageable with said notches of said mast, a pedal operatively connected to said pivotable member for moving said pivotable member and said ribbed portion thereof to an unlocking position such that said ribbed portion is disengaged from one of said notches of said mast when said pedal is depressed, and means connected to said pedal for normally biasing said pivotable member and said ribbed portion thereof toward a locking position at which said ribbed portion of said pivotable member engages one of said notches of said mast.

6. Workpiece-treating apparatus as set forth in claim 5, wherein:

said biasing means comprises a counterweight operatively connected to said pedal so as to normally tend to move said pedal, in a direction opposite to the direction in which said pedal is depressed, as a result of normal gravitational movement of said counterweight.

7. Workpiece-treating apparatus comprising a first container, which has an open top and is adapted to contain a work-piece-treating bath of a first composition, a second container, which has an open top and is adapted to contain a workpiece-treating bath of a second composition, and means for conveying workpieces successively into said first container, out from said first container, into said second container, and out from said second container, said conveying means comprising:

a carrousel having three workpiece-holding platforms, each one of said platforms being configured to fit into each one of said containers through means of said open top thereof; and means for mounting said carrousel so as enable said platforms to be conjointly and selectively raised to an upper level or lowered to a lower level and so as to enable said carrousel to be selectively indexed about a vertical axis through a cycle of three working positions when said platforms are raised to said upper level;

wherein said containers are respectively positioned such that a selected one of said is lowerable into said first container through said open top of said first container, and a different one of said platforms is lowerable into said second container through said open top of said second container at each working position of said carrousel; and wherein further said means for mounting said carrousel comprises a vertically reciprocable mast for elevating and lowering said carrousel and said workpiece-holding platforms thereof;

first locking means defined upon said vertically reciprocable mast; and second locking means releasably engageable with said first locking means of said mast such that when said second locking means is engaged with said first locking means of said mast, said mast, said carrousel, and said platforms of said carrousel may undergo vertical movement so as to raise said platforms out of said containers or to lower said platforms into said containers but may not undergo rotary indexed movements between said work positions, yet when said second locking means is released from engagement with said first locking means of said mast, said mast, said carrousel, and said platforms of said carrousel may undergo rotary indexed movements between said work positions provided said mast, said carrousel, and said platforms have been raised to said upper level.

8. The workpiece-treating apparatus of claim 7 comprising means for rotating each platform individually, about a vertical axis, for a selected period of time.

9. The workpiece-treating apparatus of claim 7, wherein:

each platform carries an array of upright posts for supporting a workpiece thereon.

10. The workpiece-treating apparatus of claim 7, wherein:

each platform carries an array of upright posts for supporting a frusto-conical spacer for, in turn, supporting a workpiece thereon.

11. The workpiece-treating apparatus as set forth in claim 7, wherein:

said first locking means comprises a plurality of notches defined within said mast and equiangularly spaced about an outer peripheral portion of said mast so as to correspond with said working positions of said carrousel; and said second locking means comprises a pivotable member having a ribbed portion thereof releasably engageable with said notches of said mast, a pedal operatively connected to said pivotable member for moving said pivotable member and said ribbed portion thereof to an unlocking position such that said ribbed portion is disengaged from one of said notches of said mast when said pedal is depressed, and means connected to said pedal for normally biasing said pivotable member and said ribbed portion thereof toward a locking position at which said ribbed portion of said pivotable member engages one of said notches of said mast.

12. The workpiece-treating apparatus as set forth in claim 11, wherein:

said biasing means comprises a counterweight operatively connected to said pedal so as to normally tend to move said pedal, in a direction opposite to the direction in which said pedal is depressed, as a result of normal gravitational movement of said counterweight.

13. A workpiece-treating method, comprising the steps of:

providing a workpiece-treating bath within a container having an open top;

providing a means for conveying workpieces into and out from said container, said conveying means comprising a carrousel having workpiece-holding platforms including a first platform and a second platform, each one of said platforms being configured so as to fit into said container through means of said open top thereof, and means for mounting said carrousel so as to enable each one of said platforms to be selectively raised to an upper level or lowered to a lower level and to enable said carrousel to be selectively indexed through a cycle of working positions when each one of said platforms is raised to said upper level, said means for mounting said carrousel comprising a vertically reciprocable mast for elevating and lowering said carrousel and said workpiece-holding platforms thereof;

providing a first locking means upon said vertically reciprocable mast;

providing a second locking means for releasable engagement with said first locking means of said mast such that when said second locking means is engaged with said first locking means of said mast, said mast, said carrousel, and said platforms of said carrousel may undergo vertical movement so as to raise one of said platforms out of said container or lower one of said platforms into said container but may not undergo rotary indexed movements between said working positions, yet when said second locking means is released from engagement with said first locking means of said mast, and mast, said carrousel, and said platforms of said carrousel may undergo rotary indexed movements between said working positions provided said mast, said carrousel, and said platforms have been raised to said upper level;

elevating said mast so as to raise said carrousel and said platforms thereof to said upper level so as to dispose said first one of said platforms at a first loading/unloading working position while disposing said second one of said platforms at a second work-treatment position at which said container is disposed;

placing an untreated workpiece onto said first platform disposed at said first loading/unloading working position;

releasing said second locking means from engagement with said first locking means and indexing said carrousel to an adjacent one of said working positions such that said first platform is moved from said first loading/unloading working position to said second work-treatment position so as to be lowerable into said container while said second platform is moved from said second work-treatment position to said first loading/unloading position;

re-engaging said second locking means with said first locking means so as to rotatably lock said mast and said carrousel at a rotary position at which said first platform is disposed at said second work-treatment position and said second platform is disposed at said first loading/unloading position;

lowering said mast and said carrousel so as to lower said first platform into said container;

performing a work-treatment operation upon said workpiece disposed upon said first platform while said first platform is disposed within said container;

elevating said mast and said carrousel so as to raise said first platform from said container;

placing an untreated workpiece upon said second platform disposed at said first loading/unloading working position;

releasing said second locking means from engagement with said first locking means and indexing said carrousel to an adjacent one of said working positions such that said second platform is moved from said first loading/unloading working position to said second work-treatment position so as to be lowerable into said container while said first platform is moved from said second work-treatment position to said first loading/unloading position;

re-engaging said second locking means with said first locking means so as to rotatably lock said mast and said carrousel at a rotary position at which said first platform is disposed at said first loading/unloading position and said second platform is disposed at said second work-treatment position;

removing said treated workpiece from said first platform disposed at said first loading/unloading position and placing an untreated workpiece onto said first platform while said first platform is disposed at said first loading/unloading position; and lowering said mast and said carrousel so as to lower said second platform into said container for performance of a work-treatment operation upon said workpiece disposed upon said second platform while said second platform is disposed within said container in a manner similar to said work-treatment previously performed upon said workpiece disposed upon said first platform.

14. The workpiece-treating method of claim 13 comprising, between each lowering step and the raising step following such lowering step, a step of rotating each platform about a vertical axis for a selected period of time.

15. A workpiece-treating method, comprising the steps of:

providing a workpiece-treating bath of a first composition within a first container having an open top, a workpiece-treating bath of a second composition within a second container having an open top;

providing a means for conveying workpieces successively into said first container, out from said first container, into said second container, and out from said second container, said conveying means comprising a carrousel having first, second, and third workpiece-holding platforms, each one of said platforms being configured so as to fit into each one of said containers through means of said open tops thereof, and means for mounting said carrousel so as to enable said platforms to be conjointly and selectively raised to an upper level or lowered to a lower level and to enable said carrousel to be selectively indexed about a vertical axis through means of a cycle of three working positions when said platforms are raised to said upper level, said means for mounting said carrousel comprising a vertically reciprocable mast for elevating and lowering said carrousel and said workpiece-holding platforms thereof;

providing a first locking means upon said vertically reciprocable mast;

providing a second locking means for releasable engagement with said first locking means of said mast such that when said second locking means is engaged with said first locking means of said mast, said mast, said carrousel, and said platforms of said carrousel may undergo vertical movement so as to raise two of said three platforms out of said first and second containers or lower two of said three platforms into said first and second containers but may not undergo rotary indexed movements between said three working positions, yet when said second locking means is released from engagement with said first locking means of said mast, said mast, said carrousel, and said platforms of said carrousel may undergo rotary indexed movements between said three working positions provided said mast, said carrousel, and said platforms of said carrousel have been raised to said upper level;

elevating said mast so as to raise said carrousel and said platforms thereof to said upper level so as to dispose said first platform at a first loading/unloading working position of said three working positions, while disposing said second platform at a third work-treatment position at which said second container is disposed and disposing said third platform at a second work-treatment position at which said first container is disposed;

placing an untreated workpiece onto said first platform disposed at said first loading/unloading working position;

releasing said second locking means from engagement with said first locking means and indexing said carrousel to an adjacent one of said working positions such that said first platform is moved from said first loading/unloading working position to said second work-treatment position so as to be lowerable into said first container, said second platform is moved from said third work-treatment position to said first loading/unloading working position, and said third platform is moved from said second work-treatment position to said third work-treatment position so as to be lowerable into said second container;

re-engaging said second locking means with said first locking means so as to rotatably lock said mast and said carrousel at a rotary position at which said first platform is disposed at said second work-treatment position, said second platform is disposed at said first loading/unloading working position, and said third platform is disposed at said third work-treatment position;

lowering said mast and said carrousel so as to lower said first platform into said first container and said third platform into said second container;

performing a work-treatment operation upon said workpiece disposed upon said first platform while said first platform is disposed within said first container;

elevating said mast and said carrousel so as to raise said first platform from said first container and said third platform from said second container;

placing an untreated workpiece upon said second platform disposed at said first loading/unloading working position;

releasing said second locking means from engagement with said first locking means and indexing said carrousel to an adjacent one of said working positions such that said second platform is moved from said first loading/unloading position to said second work-treatment position so as to be lowerable into said first container, while said first platform is moved from said second work-treatment position to said third work-treatment position so as to be lowerable into said second container, and said third platform is moved from said third work-treatment position to said first loading/unloading working position;

re-engaging said second locking means with said first locking means so as to rotatably lock said mast and said carrousel at a rotary position at which said first platform is disposed at said third work-treatment position, said second platform is disposed at said second work-treatment position, and said third platform is disposed at said first loading/unloading working position;

lowering said mast and said carrousel so as to lower said first platform into said second container and said second platform into said first container;

performing a second work-treatment operation upon said workpiece disposed upon said first platform while said first platform is disposed within said second container, and a first work-treatment operation upon said workpiece disposed upon said second platform while said second platform is disposed within said first container;

elevating said mast and said carrousel so as to raise said first platform from said second container and said second platform from said first container;

placing an untreated workpiece upon said third platform disposed at said first loading/unloading working position;

releasing said second locking means from engagement with said first locking means and indexing said carrousel to an adjacent one of said working positions such that said first platform is moved from said third work-treatment position to said first loading/unloading working position, said second platform is moved from said second work-treatment position to said third work-treatment position so as to be lowerable into said second container, and said third platform is moved from said first loading/unloading position to said second work-treatment position so as to be lowerable into said first container;

re-engaging said second locking means with said first locking means so as to rotatably lock said mast and said carrousel at a rotary position at which said first platform is disposed at said first loading/unloading working position, said second platform is disposed at said third work-treatment position, and said third platform is disposed at said second work-treatment position;

removing said treated workpiece from said first platform disposed at said first loading/unloading position in view of the fact that said treated workpiece has completed its work-treatment processing, and placing an untreated workpiece onto said first platform while said first platform is disposed at said first loading/unloading position so as to commence a subsequent workpiece treatment process upon said untreated workpiece disposed upon said first platform while said workpiece-treatment processing is completed upon said workpieces disposed upon said second and third platforms in a manner similar to said workpiece treatment processing previously performed upon said treated workpiece previously disposed upon said first platform.

16. The workpiece-treating method of claim 15, wherein:

each platform carries an array of upright posts for supporting a workpiece thereon; and wherein each placing step includes placing a plurality of similar workpieces, each one of said workpieces being placed onto a different one of said posts.

17. The workpiece-treating method of claim 15 comprising, between each lowering step and the raising step following such lowering step, a step of rotating each platform about a vertical axis for a selected period of time.

18. The workpiece-treating method of claim 17 wherein each of said workpieces is a coil of collated nails, wherein the workpiece-treating bath of the first composition is a nail-cleaning bath, and wherein the workpiece-treating bath of the second composition is a nail-coating bath.

* * * * *